US005094431A

United States Patent [19]

Liimatainen et al.

[11] Patent Number: 5,094,431

[45] Date of Patent: Mar. 10, 1992

[54] CAR BOTTOM FURNACE SYSTEM AND METHOD OF OPERATION THEREOF

[75] Inventors: Bruce C. Liimatainen, Riverside; Algirdas A. Underys, Arlington Heights, both of Ill.

[73] Assignee: A. Finkl & Sons Co., Chicago, Ill.

[21] Appl. No.: 591,538

[22] Filed: Oct. 2, 1990

[51] Int. Cl.[5] ..... F27D 3/12

[52] U.S. Cl. ..... 266/165; 266/276; 432/241; 432/242

[58] Field of Search ..... 266/44, 165, 166, 276; 432/241, 242

[56] References Cited

U.S. PATENT DOCUMENTS

| | | | |
|---|---|---|---|
| 2,003,450 | 6/1935 | Ladd | 432/241 |
| 3,168,299 | 2/1965 | Miller | 432/241 |
| 4,578,031 | 3/1986 | Johnson et al. | 432/241 |
| 4,764,109 | 8/1988 | Meyers | 432/241 |

OTHER PUBLICATIONS

Thermal Ceramics, *Kaowool Ceramic Fibers Products*, 4-89, pp. 1-10.

*Primary Examiner*—S. Kastler

*Attorney, Agent, or Firm*—James G. Staples

[57] ABSTRACT

A movable car bottom furnace in which premature failure of the metallic components of the movable car bottom are avoided by moving a hinged lower portion of the side wall into engagement with the refractory portion of the car bottom whereby only a refractory to refractory contact is made between the walls and car bottom, with all said contact occurring at a level above the uppermost level of the metallic components of the car bottom.

5 Claims, 2 Drawing Sheets

CAR BOTTOM FURNACE SYSTEM AND METHOD OF OPERATION THEREOF

This invention relates in general to car bottom type furnaces and specifically to such a furnace which minimizes combustion gas exfiltration and minimizes cold air infiltration and radiation loss. It further specifically relates to a method of sealing a car bottom type furnace which attains the above objectives, avoids the drawbacks of the sand, water, barometric, fiber swing and fiber abrasives seals now conventionally used in the industry and, in particular, provides shielding of the car top refractory castings from the furnace environment.

BACKGROUND OF THE INVENTION

Car bottom type furnaces are used in many industrial applications for heat treating metal parts. One long established use is in connection with heat treat furnaces used in forging operations. Accordingly the invention will be described in conjunction with this use.

During the processing of forged steel parts from ingot to finished product, the semi-finished product must be subjected one or more times to heat treatment to attain certain desirable properties such as ductility, hardenability, etc. The partly or semi-finished product is conventionally placed by a crane or other means onto a car bottom which runs on rails, and the car bottom with the parts to be heat treated are rolled into a furnace structure having a top, two side walls, and two end walls, at least one of which end walls can be lowered and raised to enable the car bottom to be rolled in and out. The wheeled, movable car bottom forms the bottom of the furnace after it is wheeled into position and the end entry wall closed.

After subjection to hot gases in the furnace for a predetermined time the end wall or door is opened and the car bottom with the treated parts is rolled out and moved to the next processing station.

It is essential that the furnace be as tight as operating conditions permit and have a long useful life between relinings for economic reasons. In this connection the seal which must be formed between the lower edges of the side and end walls, and the car bottom, must be tight and efficient so that loss of the high temperature gases inside the furnace is minimized to the maximum practicable extent, and infiltration of relatively cold ambient air, which would lower the efficiency of the furnace, is precluded. Further, since the temperature in the furnace may be as high as 2400 degrees F, the furnace elements become very hot and radiant heat loss can be substantial if the sealing system is not efficient and cracks are present.

A particular problem has been the maintenance of the castings which confine the car top refractory. As is well known, the car is usually constructed in the form of a flat bed structural steel frame assembly which is supported by two or more axle and wheel assemblies, and a layer of ceramic brick which forms a bottom surface upon which the parts to be treated rest during their dwell in the furnace. In many current structures the upper edges at least of these castings are exposed to the heat of the furnace and, unless constructed of very expensive, exotic alloy materials, oxidize and lose their strength before the end of a furnace campaign.

Conventional methods of sealing include sand seals, water seals, barometric seals, fiber swing seals and fiber abrasive seals. Each of these conventional systems has one or more drawbacks which this invention overcomes.

Sand seals, though they can be quite effective, are subject to loss of sand and hence loss of efficiency, require high alloy, expensive castings to contain the sand, and are rather difficult to effectively seal at the corners.

Water seals, which can be quite effective, are subject to evaporation and hence loss of effectiveness (which experience proves to be a common problem even in the most maintenance conscientious shop), are prone to refractory damage due to contact between the refractories and water, and, as a system, are quite costly.

Barometric seals are subject to radiation loss and infiltration and exfiltration of cold ambient air and hot combustion gases respectively.

Fiber abrasive seals require substantial maintenance and replacement costs are quite high.

Fiber swing seals require high alloy castings which can prove uneconomical over time. Such seals are now probably the state of the art in sealing at least low temperature car type furnaces. Usually ceramic fiber is pushed into the gap between the car and the furnace. However, the problem with swing type fiber seals is that castings are required to restrain the car top refractory, and with such a swing type seal the castings are subjected to furnace operating temperatures. At forging temperatures which, as mentioned, can be up to 2400 degrees F, these castings oxidize and lose their strength. The only way to ensure continuous and relatively maintenance free use of a swing seal at high temperatures is to construct the components of exotic alloy castings. These however are very expensive.

SUMMARY OF THE INVENTION

It is an object of the invention to provide a sealing system which has a low initial cost, is effective in operation, requires minimal maintenance, and has a long useful life. This is attained by constructing the furnace walls with an upper, fixed section and a lower section which is swingable into contact with the car top refractory above the castings, and, simultaneously, into contact with the lower portion of the upper fixed section of the adjoining lower wall sections, and between the lower wall section and the car top refractory.

BRIEF DESCRIPTION OF THE DRAWING

The invention is illustrated more or less diagrammatically in the accompanying drawing wherein.

DETAILED DESCRIPTION OF THE INVENTION

Figure 1:
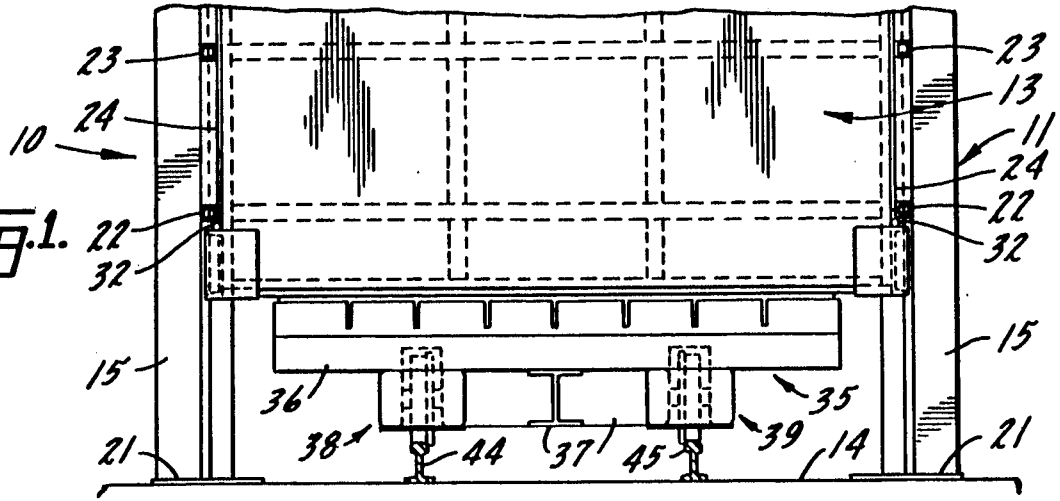
FIG. 1 is an end view of the car bottom furnace of this invention with the furnace shown in a closed, operating condition.

Like reference numerals will be used to refer to like parts from Figure to Figure of the drawing.

Figure 2:
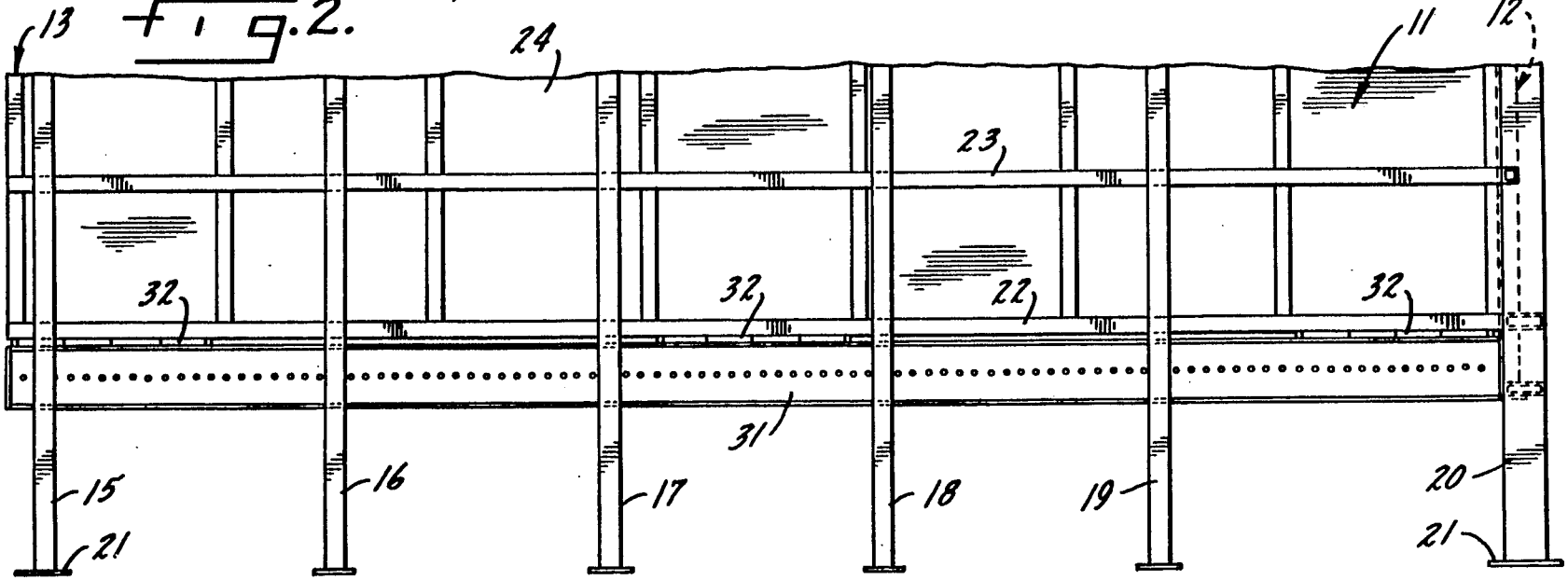
FIG. 2 is an outside view of one of the large side walls of the furnace illustrating the two part construction of the furnace side wall.

Referring first to FIGS. 1 and 2, the car bottom type furnace of this invention is there shown to consist of a pair of long side walls, indicated generally at 10 and 11, a rear end wall indicated generally at 12, and a front end wall indicated generally at 13. Ground level is indicated at 14.

Side wall 11 includes a plurality, in this instance six, vertical side ribs 15–20 respectively. Each side rib rests on a foot pad 21 which is secured to the floor by any suitable means. A plurality of cross braces are indicated at 22 and 23, the braces being, in this instance, located on the inside face of the vertical side ribs as seen in all the Figures. Here the cross braces are square shaped tubing but any suitable configuration may be employed.

Figure 3:
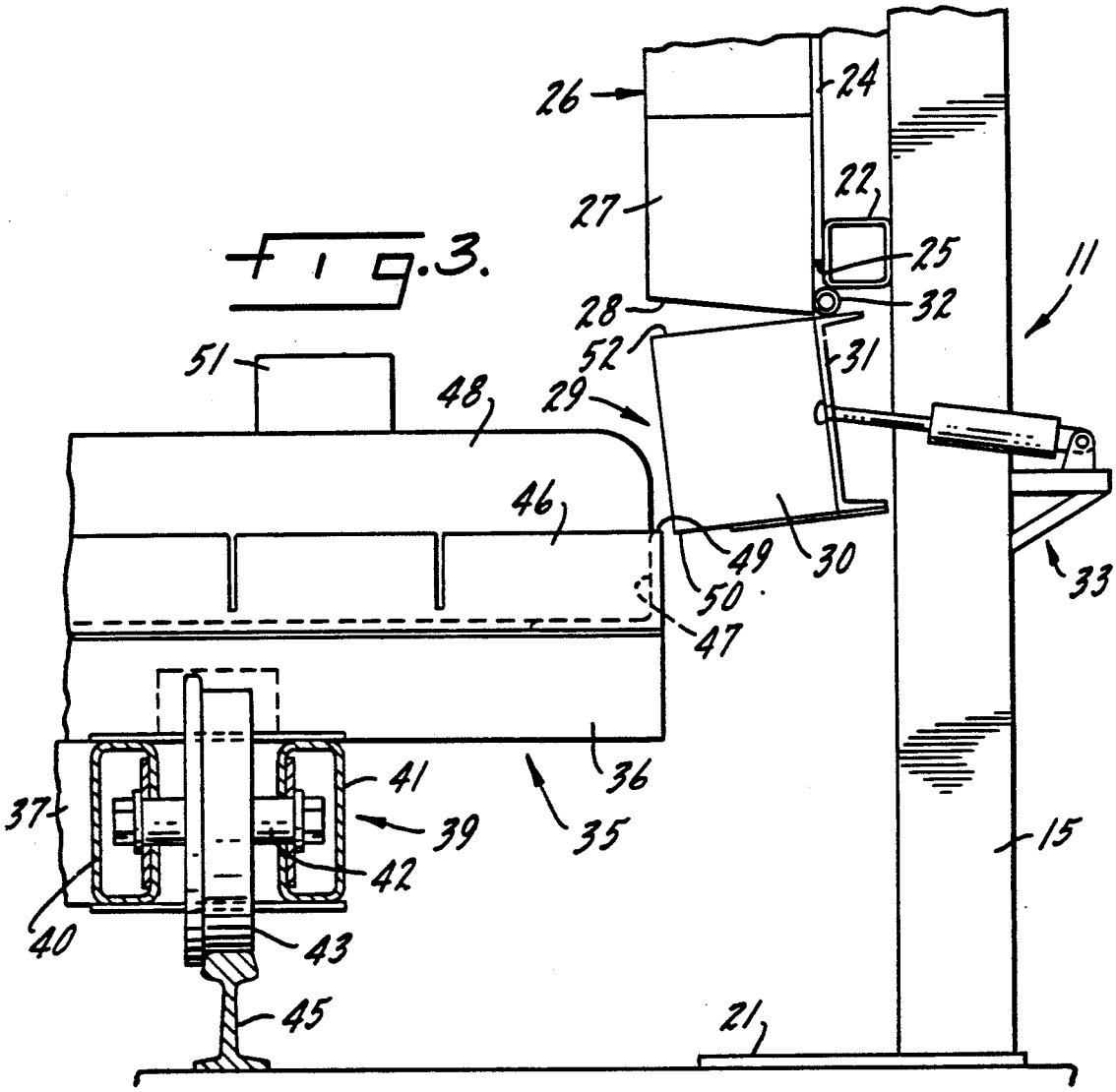
FIG. 3 is an end view of the furnace to a larger scale than FIG. 1 with the end wall removed and showing the relative position of the car bottom to the balance of furnace prior to sealing.
Figure 4:
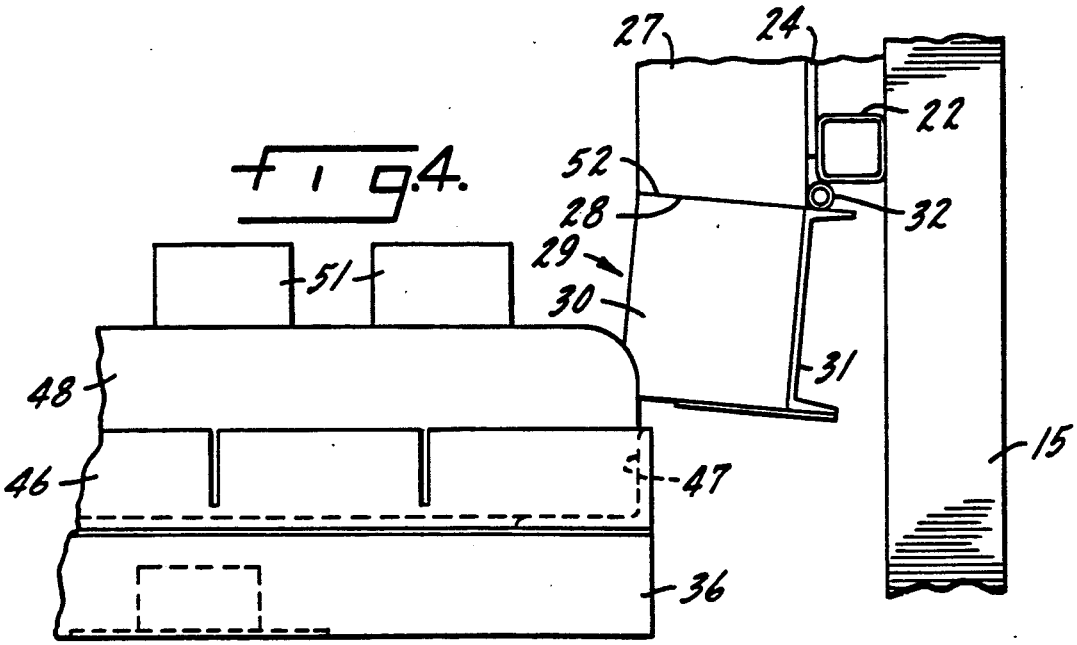
FIG. 4 is a view similar to FIG. 3 with parts omitted for clarity showing the furnace in a closed and sealed condition.

An upper wall plate is indicated at 24, the wall plate being secured to the upper cross brace 23 and, as best seen in FIGS. 3 and 4, the lower cross brace 22. It will be noted that the bottom edge 25 of the upper wall plate 24 contacts only about the upper half of the inner wide flat surface of the cross brace 22. A refractory wall lining is indicated generally at 26, the lining being composed of courses of high temperature brick or other suitable refractory materials, and secured to the wall plate 24 by any suitable means, the exact configuration of which does not form an essential part of the invention. For purposes of clarity and description, the lowest course of brick in the upper refractory wall lining 26 is indicated at 27. From FIG. 3 it will be noted that the lower edge 28 of brick course 27 is angled as contrasted to the horizontal orientation of the upper edge of brick course 27.

The lower refractory wall lining is indicated generally at 29. In this instance for purpose of clarity and description, the lower lining 29 is assumed to consist of a single course of deformable refractory material indicated at 30. The refractory material 30 is secured by any suitable means to the lower wall plate 31 which in this instance is shown as a generally U-shaped channel member. A lower wall hinge is indicated generally at 32, the hinge having its upper half welded or otherwise suitably fastened to cross brace 22 and its lower half similarly welded or otherwise suitably secured to the lower wall plate 31.

Means for moving the lower refractory wall lining 29 about the axis of hinge 32 is indicated at 33, the means in this instance being diagrammatically represented by a cylinder pivotally mounted to a fixed location with respect to side wall 11, and with the outer end of its piston rod secured to the lower wall plate 31.

A car bottom for the furnance is indicated generally at 35. The car bottom includes an upper structural frame indicated at 36, a sub-frame 37, and a pair or wheel assemblies indicated generally at 38, 39. As best seen in FIG. 3, wheel assembly 39 includes a pair of axial mounting frames 40, 41 which receive axle 42 upon which wheel 43 is mounted. The wheels roll along tracks 44, 45 for moving the car bottom 35 into an out of the furnance.

A series of car bottom castings extend upwardly from the main frame 36. In this instance an end casting is indicated at 46 and a side casting at 47. These car bottom castings form a nest or receptacle for the ceramic brick structure 48 which projects upwardly above the upper end of the castings, and which provides a bottom upon which products to be heat treated are placed.

It should be particularly noted from FIG. 3 that the upper edge 49 of the car bottom castings is located at an elevation no higher than the lower, inner edge 50 of refractory material course 30.

The use and operation of the invention is as follows.

Products, such as semi-finished forgings, indicated diagrammatically at 51, are placed on the upper surface of the ceramic bottom 48 of the car bottom 35 by a crane or other suitable means. The loaded car bottom is then wheeled into the furnance enclosure along rails 44, 45, with front wall 13 in an open position. After the car bottom comes to rest in its operative position the cylinder and piston assembly 33 is actuated to swing the lower refractory wall lining 29 about the axis of the hinge 32 from its open position of FIG. 3 to the closed, sealing position of FIG. 4. In the closed and sealed position the upper edge 52 of lower refractory material course 30 moves into abutting, sealing contact with the lower edge 28 of brick course 27 thereby forming a seal between these two courses.

Simultaneously, the lower, inner portion of the refractory material 30 engages the edge of the periphery of brick bottom 48, as best seen in FIG. 4, to make a tight seal between the car bottom and the lower wall lining 29. Of particular significance is that the seal between the brick bottom 48 and lower wall lining 29 is formed above the end and side castings 46, 47 so that these critical components are never exposed to the high heat in the furnace. After front wall or door 13 is closed, the furnace burners are operated.

It will thus be noted that a car bottom type furnace has been illustrated and described which overcomes the deficiencies of the prior art in an economical and practical manner.

Although a preferred embodiment of the invention has been shown and described, it will at once be apparent to those skilled in the art that modifications of the invention can be made without departing from the spirit and scope of the invention Accordingly, it is intended that the scope of the invention be limited solely by the hereafter appended claims when interpreted in light of the relevant prior art, and not by the foregoing exemplary description.

We claim:

1. In a car bottom furnace in which a movable bottom which supports work pieces forms a portion of the furnace enclosure, the combination of a car bottom having a metallic support frame adapted to be moved into and out of sealing engagement with the balance of the furnace, said car bottom including a work piece support platform composed of heat resistant non-metallic refractory.

upper edge portions of said heat resistant non-metallic refractory extending upwardly to an elevation higher than the metallic support frame of said car bottom, and wall means having a heat resistant refractory portion surrounding the car bottom when said car bottom is in operating position within the furnace enclosure, said wall means having a lower portion thereof which is movable into contact with the car bottom to thereby form a seal at the area of abutting contact between the car bottom and said movable portion of the wall means, the upper edge of the work piece support platform of the car bottom being located at an elevation no higher than the lower edge of the movable wall means, said area of abutting contact being formed between the refractory portion of the wall means and the heat resistant non-metallic refractory portion of the car bottom above the metallic support frame, whereby no metallic parts associated with the car bottom or the heat resisting refractory portion of the wall means is exposed to the furnace atmosphere during operation.

2. The combination of claim 1 wherein the refractory portion of the lower portion of the all means is deformable so as to be adaptable to the contour of the heat resistant non-refractory portion of the car bottom.

3. The combination of claim 2 wherein the car bottom is wheel mounted for movement into and out of the furnace enclosure.

4. The combination of claim 1 wherein said lower portion of the wall means is separable from the upper portion in an inoperative condition and makes sealing engagement with the upper portion simultaneously with making sealing engagement with the car bottom.

5. A method of forming a car bottom type furnace which excludes exposure of metallic components to the furnace environment in an operating condition, said method including the steps of providing a furnace enclosure having top and wall portions, one section of said wall portion being movable into and out of contact with the balance thereof, positioning a car bottom in the furnace enclosure, moving said one section of said wall portion into engagement with the car bottom and, sealing the car bottom to the wall means by moving the lower portion of the wall means into sealing contact with the refractory portion of the car bottom above all metal components thereof.

* * * * *